US012103651B2

(12) United States Patent
Tseng

(10) Patent No.: US 12,103,651 B2
(45) Date of Patent: Oct. 1, 2024

(54) MULTI-FUNCTION OAR

(71) Applicant: Chuan Jiing Enterprise Co., Ltd., Taichung (TW)

(72) Inventor: Tien Tsai Tseng, Taichung (TW)

(73) Assignee: CHUAN JIING ENTERPRISE CO., LTD., Taichung (TW)

( * ) Notice: Subject to any disclaimer, the term of this patent is extended or adjusted under 35 U.S.C. 154(b) by 416 days.

(21) Appl. No.: 17/534,113

(22) Filed: Nov. 23, 2021

(65) Prior Publication Data

US 2023/0159146 A1 May 25, 2023

(51) Int. Cl.

| | |
|---|---|
| ***B63H 16/04*** | (2006.01) |
| ***B63B 13/00*** | (2006.01) |
| ***F04B 1/22*** | (2006.01) |
| ***F04B 9/14*** | (2006.01) |

(52) U.S. Cl.

CPC ..... *B63H 16/04* (2013.01); *B63B 13/00* (2013.01); *F04B 1/22* (2013.01); *F04B 9/14* (2013.01)

(58) Field of Classification Search

CPC . B63H 16/04; B63B 13/00; F04B 1/22; F04B 9/14

USPC ..... 440/101–110

See application file for complete search history.

(56) References Cited

U.S. PATENT DOCUMENTS

| | | | | |
|---|---|---|---|---|
| 3,044,410 | A * | 7/1962 | Edmundson | B63H 16/04 416/74 |
| 5,163,778 | A * | 11/1992 | Botero | B63B 13/00 114/221 R |
| 6,027,386 | A * | 2/2000 | Hains | B63B 13/00 114/221 R |
| 11,492,087 | B2 * | 11/2022 | Dufault | B63H 11/00 |
| 11,511,839 | B1 * | 11/2022 | Peng | F04B 53/1032 |
| 2020/0277034 | A1 * | 9/2020 | Dufault | B63H 11/04 |

FOREIGN PATENT DOCUMENTS

| | | |
|---|---|---|
| TW | M590565 | 2/2020 |
| TW | M615306 | 8/2021 |

* cited by examiner

*Primary Examiner* — Anthony D Wiest

(74) *Attorney, Agent, or Firm* — Bradley J. Thorson; DeWitt LLP

(57) ABSTRACT

A multi-function oar has an oar blade, a large-diameter tube, and a small-diameter tube. The oar blade has a tube-connecting portion. The tube-connecting portion has a through axial hole. The large-diameter tube is movably inserted in the axial hole. The axial hole has an upper positioning portion and a lower positioning portion for positioning the large-diameter tube, thereby changing the overall length of the oar. The large-diameter tube has a first check valve. The first check valve has a bail opening. The small-diameter tube is provided with a second check valve and an operating member having a water outlet, so as to bail water and drain water.

9 Claims, 7 Drawing Sheets

MULTI-FUNCTION OAR

FIELD OF THE INVENTION

The present invention relates to an oar, and more particularly to a multi-function oar.

BACKGROUND OF THE INVENTION

An oar is an implement used for manpowered small boats, such as rubber dinghies and canoes, for rowing. However, water may splash into the boat while traveling, so the water in the boat needs to be drained.

A conventional oar, as disclosed in Taiwan Utility Model Publication Nos. M590565, M615306 and US Patent Application Publication No. 20200277034, has an outer tube and an inner tube. The two tubes are insertedly connected to each other and equipped with a push valve to form a retractable oar shaft serving as a bail pump. The oar shaft is firmly combined with an oar blade. Thus, the oar has a paddling function and can be used as a pump to drain the water in the boat.

Although most of the inner tube of the conventional oar can be retracted into the outer tube to reduce the length of the oar shaft, the overall length of the oar combined with the oar blade is still too long. When used as a spare oar, the oar still takes up too much space. In addition, the grip or oar blade of the conventional oar has a bail opening. When the oar having the bail opening on the grip is used to bail water, the grip needs to face down. It is in the opposite direction to the paddling action, which is inconvenient to use. If the bail opening is disposed at the bottom end of the oar blade, it is not easy for the wide blade to reach the narrow part of the boat to bail water. Furthermore, the small boat often needs a spare boat hook for hooking other boats or objects floating on the water. However, the boat hook has a certain length. When the boat hook is placed in the boat, it will also occupy a space. If the boat hook is installed on the grip of the oar, the user can only grasp the oar blade in a plate shape to operate the boat hook on the end of the grip for hooking other objects. It is not easy to control the oar blade.

SUMMARY OF THE INVENTION

An object of the present invention is to provide a multi-function oar whose oar shaft can move axially relative to its oar blade, so that part of the oar shaft can be retracted into the oar blade to shorten the overall length of the oar, so as to be stored in a small space with ease.

Another object of the present invention is to provide a multi-function oar, which is able to bail water and drain water by extending and retracting the oar shaft. Besides, the oar shaft can extend out of the end of the oar to from a bail section to reach a narrow part of the boat for bailing water.

A further object of the present invention is to provide a multi-function oar, which has a boat hook for hooking other objects and forms a handle through the bail section, so that the user can operate the boat hook easily.

In order to achieve the above objects, the present invention provides a multi-function oar, comprising:

an oar blade, having a tube-connecting portion, the tube-connecting portion having a top end and a bottom end, a pair of plate portions being provided at two opposite sides of the tube-connecting portion, the tube-connecting portion further having an axial hole passing through the top end and the bottom end, the axial hole having an upper positioning portion close to the top end and a lower positioning portion close to the bottom end, the top end of the tube-connecting portion being provided with a first control member;

a large-diameter tube, inserted in the axial hole and movable axially, the large-diameter tube being provided with a first check valve facing the bottom end of the tube-connecting portion for controlling water to flow only in a direction from the bottom end toward the large-diameter tube, one end of the large-diameter tube, opposite to the oar blade, being provided with a second control member, one end of the first check valve, opposite to the oar blade, having a bail opening, the first check valve having a blocking element to cooperate with the upper positioning portion or the lower positioning portion of the axial hole for positioning the large-diameter tube;

a small-diameter tube, one end of the small-diameter tube, facing the oar blade, being provided with a second check valve for controlling water to flow only in a direction from the large-diameter tube toward the small-diameter tube, the small-diameter tube being inserted in the large-diameter tube and movable axially, an accommodation space whose volume being changeable being formed between the first check valve and the second check valve, another end of the small-diameter tube, opposite to the large-diameter tube, being provided with an operating member, the operating member having a water outlet and an passage communicating with the small-diameter tube.

Preferably, the blocking element is protruded outwardly from two opposite sides of an outer periphery of the first check valve. Two opposite sides of an inner wall of the axial hole are recessed to form a pair of slide grooves extending along the axial hole toward the top end and corresponding to the blocking element for the blocking element to be positioned at the upper positioning portion. Another two opposite sides of the inner wall of the axial hole are recessed to form a pair of recesses corresponding to the blocking element for the blocking element to be positioned at the lower positioning portion, so that the first check valve is blocked by the recesses to be outside the axial hole.

Preferably, after the large-diameter tube is moved toward the oar blade to extend out of the axial hole, a bail section exposed outside the axial hole is formed.

Preferably, a protruding portion for a user to grasp thereon extends outwardly from either side of the operating member, and the protruding portion is bent and extended toward the small-diameter tube to form a hook.

Preferably, another end of the first check valve, facing the large-diameter tube, is provided with a spring.

Preferably, the bail opening has a wavy end edge.

Preferably, the first check valve includes a first valve plate that is pivotally opened only in a direction from the bail opening toward the large-diameter tube, and the second check valve includes a second valve plate that is pivotally opened only in the direction from the large-diameter tube toward the small-diameter tube.

Preferably, the second check valve is radially provided with a pin to prevent the second valve plate from pivoting excessively.

Preferably, each of the first control member and the second control member is a screw tightening device.

DETAILED DESCRIPTION OF THE PREFERRED EMBODIMENTS

Embodiments of the present invention will now be described, by way of example only, with reference to the accompanying drawings.

Figure 1:
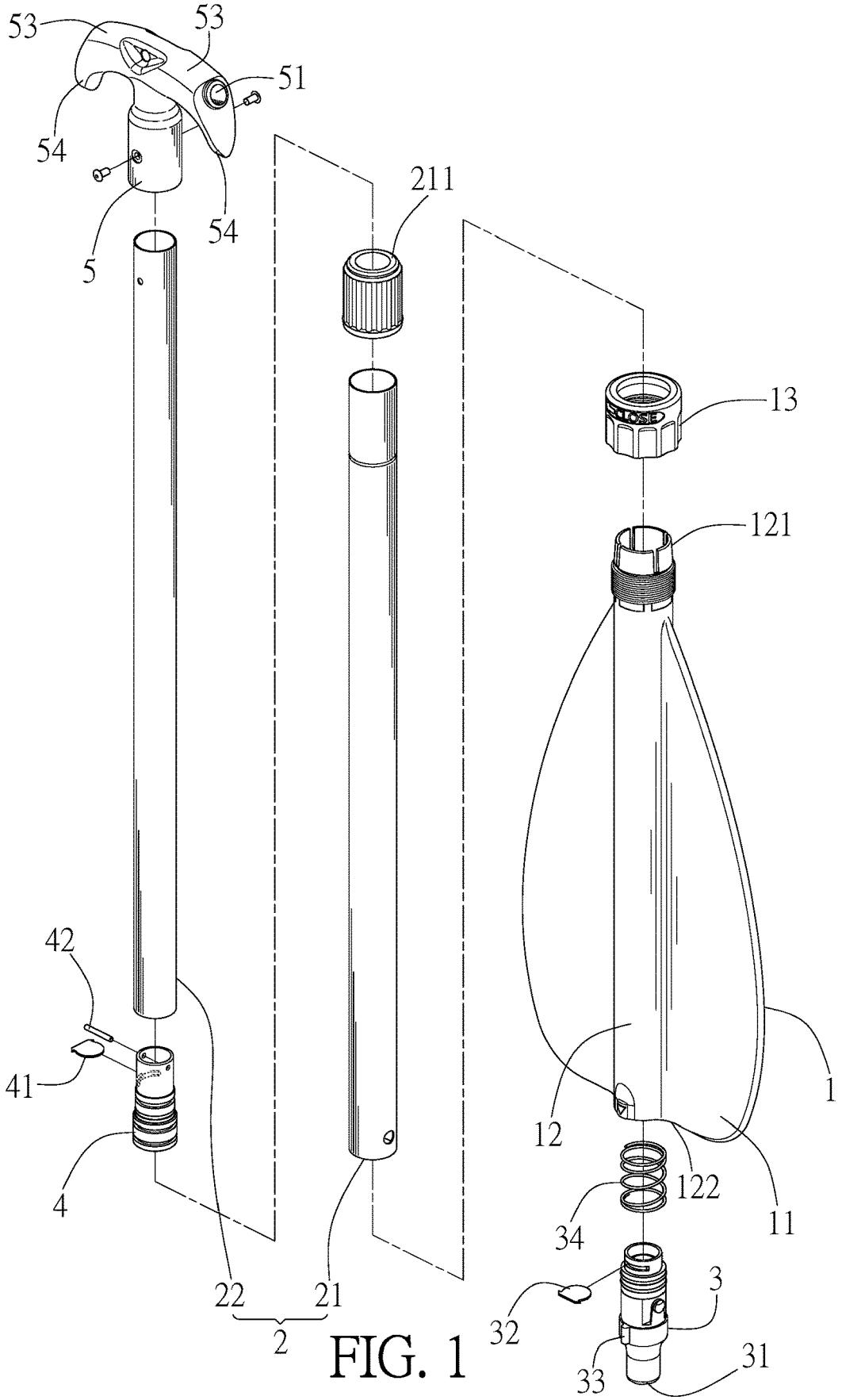
FIG. 1 is an exploded view of the present invention.
Figure 2:
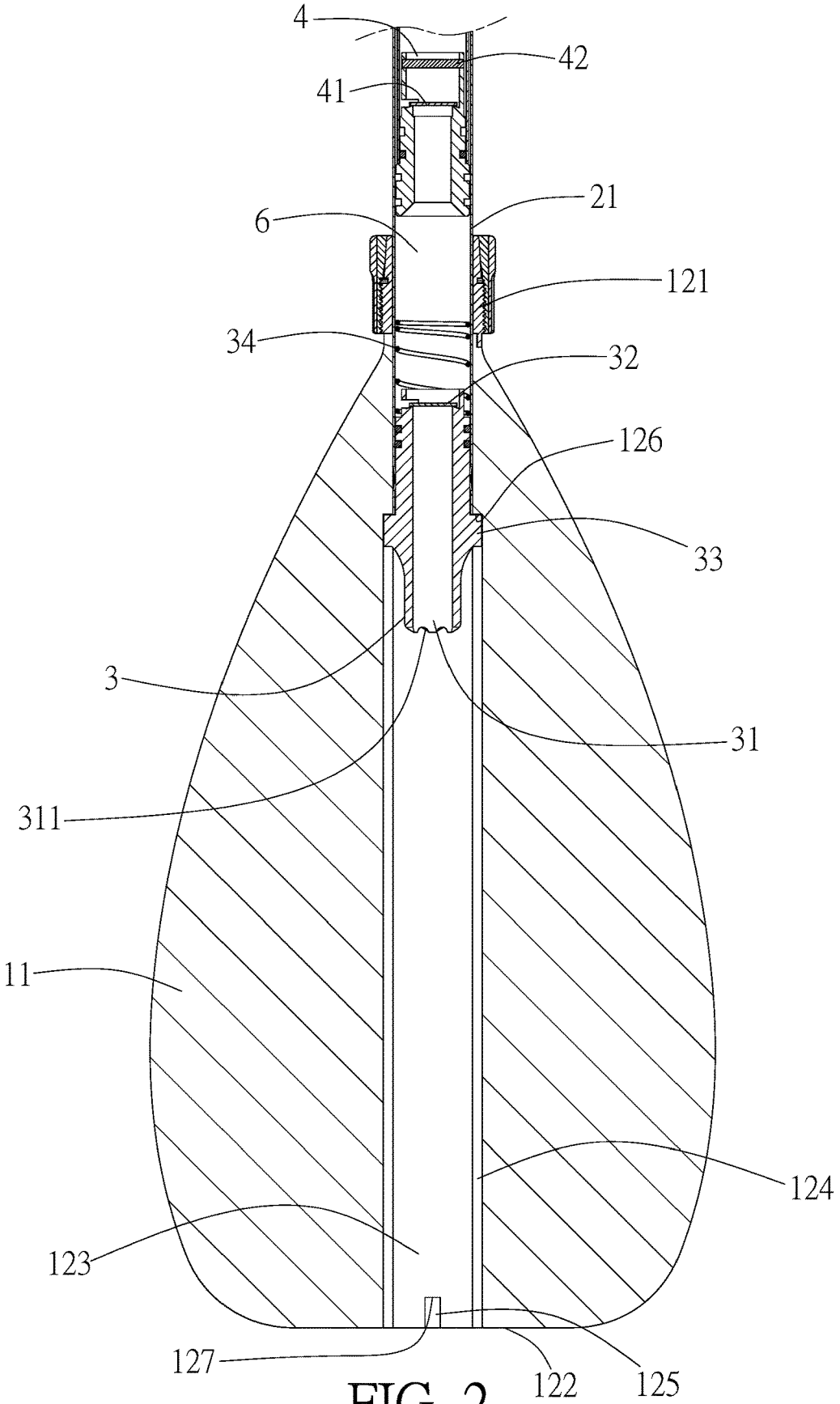
FIG. 2 is a cross-sectional view of the present invention when the large-diameter tube is extended out of the tube-connecting portion.
Figure 3:
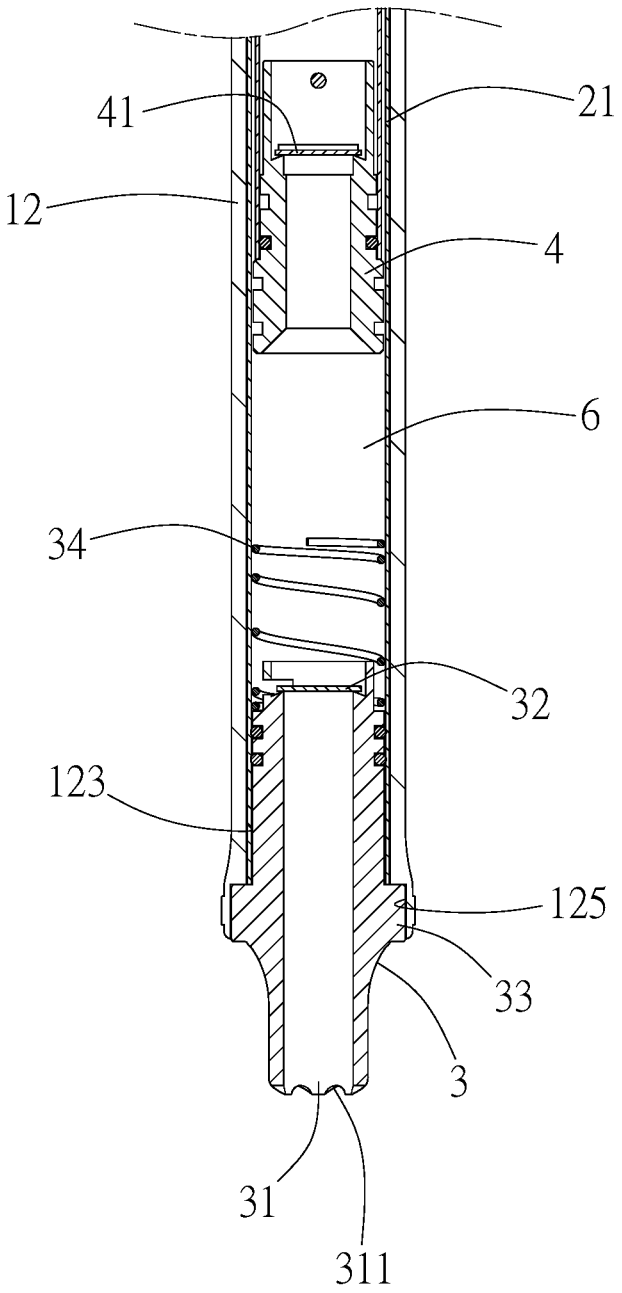
FIG. 3 is a cross-sectional view of the present invention when the large-diameter tube is retracted in the tube-connecting portion.

Referring to the FIGS. 1-3, a multi-function oar according to an embodiment of the present invention comprises an oar blade 1 and an oar shaft 2. The oar shaft 2 includes a large-diameter tube 21 and a small-diameter tube 22 that are insertedly connected to each other.

The oar blade 1 has a tube-connecting portion 12 in the form of a hollow cylinder. The tube-connecting portion 12 has a top end 121 and a bottom end 122. A pair of plate portions 11 is provided at two opposite sides of the tube-connecting portion 12. The tube-connecting portion 12 has an axial hole 123 passing through the top end 121 and the bottom end 122. The top end 121 of the tube-connecting portion 12 is provided with a first control member 13. In this embodiment, the first control member 13 is a conventional screw tightening device for tightening and securing the large-diameter tube 21. The tube-connecting portion 12 has an upper positioning portion 126 close to the top end 121 for restricting the large-diameter tube 21 from coming out of the top end 121. The tube-connecting portion 12 has a lower positioning portion 127 close to the bottom end 122. In this embodiment, two opposite sides of the inner wall of the axial hole 123, corresponding to the plate portions 11, are recessed to form a pair of slide grooves 124 extending from the bottom end 122 toward the top end 121 of the tube-connecting portion 12. Another two opposite sides of the inner wall of the axial hole 123 are recessed to form a pair of recesses 125 extending from the bottom end 122 of the tube-connecting portion 12. The top of the recess 125 forms the lower positioning portion 127.

The large-diameter tube 21 is a hollow round tube, which is inserted in the axial hole 123 and movable axially. The large-diameter tube 21 is provided with a first check valve 3 facing the bottom end 122 of the tube-connecting portion 12 for controlling water to flow only in a direction from the bottom end 122 toward the large-diameter tube 21. The first check valve 3 has a blocking element 33 to cooperate with the upper positioning portion 126 or the lower positioning portion 127 of the axial hole 123 for positioning the large-diameter tube 21. One end of the first check valve 3, opposite to the oar blade 1, has a bail opening 31. The first check valve 3 includes a first valve plate 32 that is pivotally opened only in a direction from the bail opening 31 toward the large-diameter tube 21. One end of the large-diameter tube 21, opposite to the oar blade 1, is provided with a second control member 211. In this embodiment, the second control member 211 is a conventional screw tightening device for tightening the large-diameter tube 21 and the small-diameter tube 22.

As shown in FIG. 2, the blocking element 33 of the first check valve 3 in this embodiment is protruded outwardly from two opposite sides of the outer periphery of the first check valve 3. The slide groove 124 of the oar blade 1 allows the blocking element 33 of the first check valve 3 to slide in the axial hole 123 to a position close to the top end 121 of the tube-connecting portion 12, and the blocking element 33 is positioned by the upper positioning portion 126.

As shown in FIG. 3, the blocking element 33 of the first check valve 3 is located in the recess 125 on the other two opposite sides of the inner wall of the axial hole 123. The lower positioning portion 127 of the recess 125 is configured to position the blocking element 33 so that the bail opening 31 of the first check valve 3 is blocked by the recess 125 to be outside the axial hole 123.

The small-diameter tube 22 is a hollow round tube, which is inserted in the large-diameter tube 21 and movable axially. One end of the small-diameter tube 22, facing the oar blade 1, is provided with a second check valve 4 for controlling water to flow only in a direction from the large-diameter tube 21 toward the small-diameter tube 22. The second check valve 4 includes a second valve plate 41 that is pivotally opened only in the direction from the large-diameter tube 21 toward the small-diameter tube 22.

Another end of the small-diameter tube 22, opposite to the large-diameter tube 21, is provided with an operating member 5. In this embodiment, the operating member 5 is a boat hook. The operating member 5 has a water outlet 51 and an L-shaped passage 52. The passage 52 communicates with the water outlet 51 and the small-diameter tube 22. A protruding portion 53 for a user to grasp thereon extends outwardly from either side of the operating member 5. The protruding portion 53 is further bent and extended toward the small-diameter tube 22 to form a hook 54 for hooking other objects.

As shown in FIG. 2, the second check valve 4 is radially provided with a pin 42. If the second valve plate 41 is pushed too hard by the user when it is opened, resulting in that the impact force of the water flow is too large and causing excessive pivoting, the second valve plate 41 will be stopped by the pin 42, so as to prevent the second valve plate 41 from being deformed or falling off The small-diameter tube 22 is moveable in the large-diameter tube 21, so that an accommodation space 6 is formed between the first check valve 3 and the second check valve 4. The volume of the accommodation space 6 is changeable along with the relative movement of the first check valve 3 and the second check valve 4. One end of the first check valve 3, facing the large-diameter tube 21, is provided with a spring 34. When the second check valve 4 is moved toward the first check valve 3, the spring 34 is configured to cushion the impact force.

Figure 4:
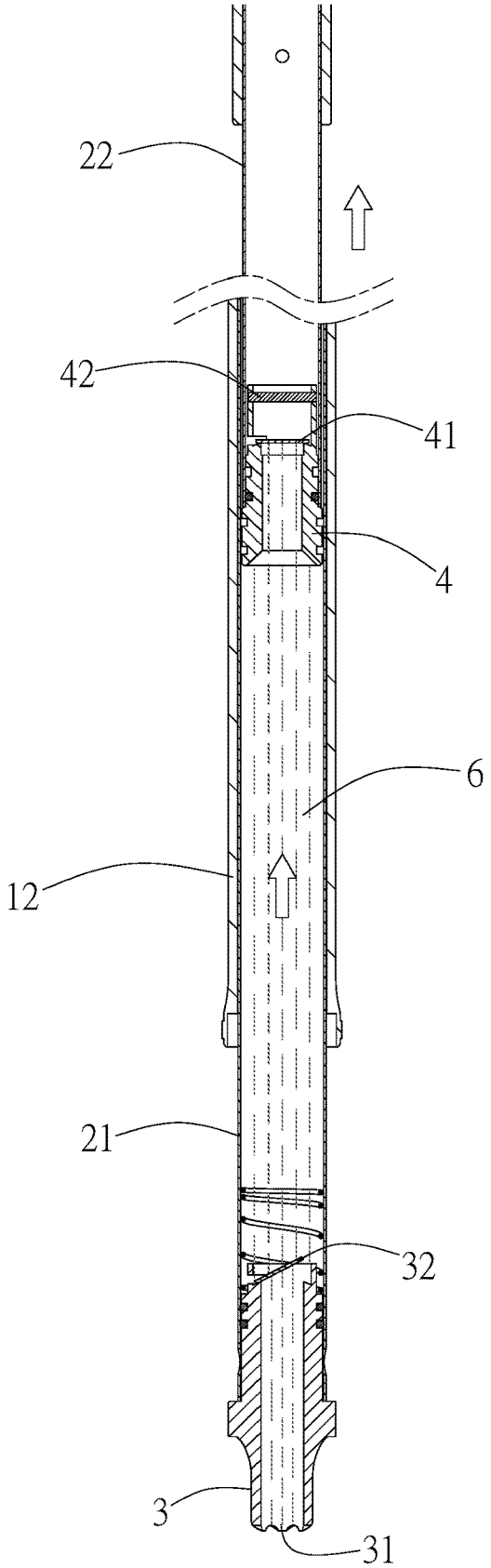
FIG. 4 is a schematic view of the bail action of the present invention.

Referring to FIG. 4, when the oar provided by the present invention is used to bail water, the bail opening 31 is immersed in the water on the boat, and the small-diameter tube 22 is pulled for the second check valve 4 to move away from the first check valve 3 to increase the accommodation space 6 and reduce the pressure inside the accommodation space 6. Therefore, the water on the boat flows through the first check valve 3 from the bail opening 31 to the accommodation space 6. At this time, the second valve plate 41 is in a closed state.

Figure 5:
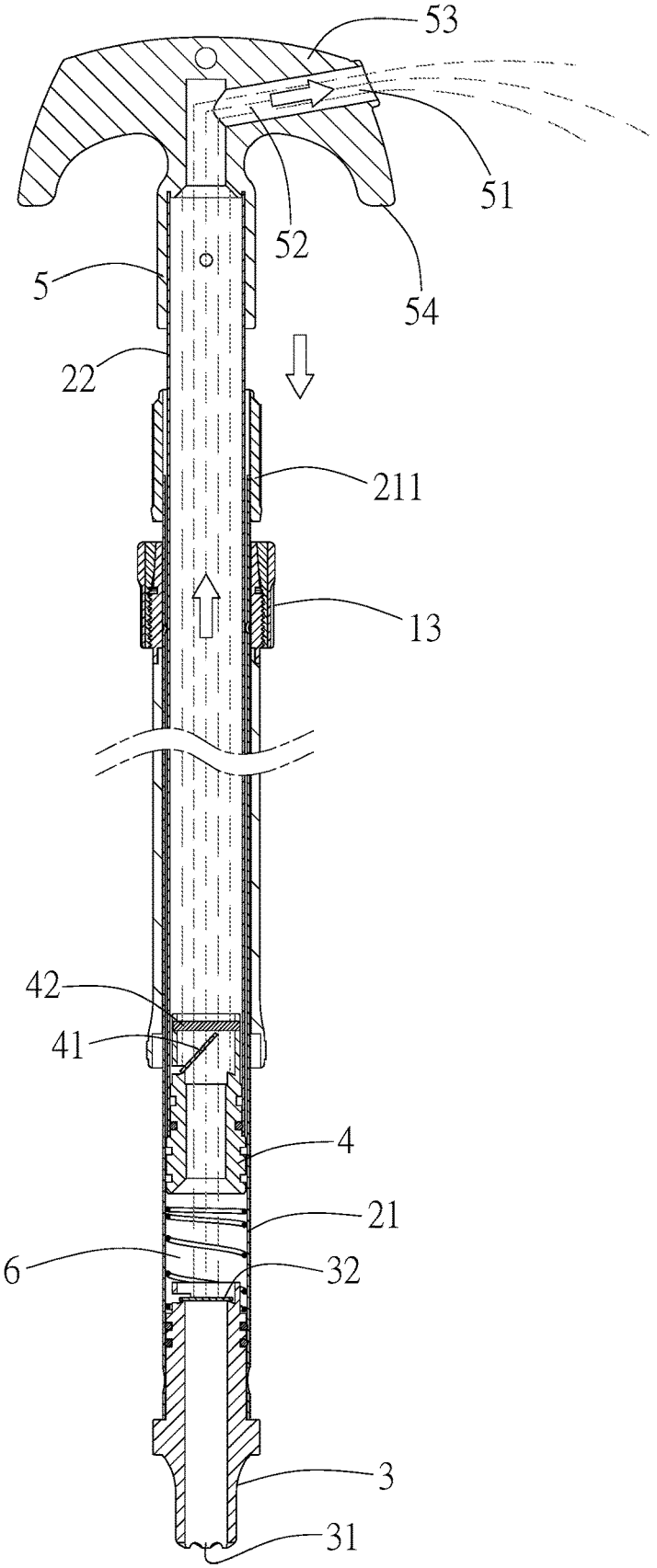
FIG. 5 is a schematic view of the drainage action of the present invention.

As shown in FIG. 5, the small-diameter tube 22 is pushed to move the second check valve 4 toward the first check valve 3 to reduce the accommodation space 6. At this time, the first valve plate 32 closes the bail opening 31, and the internal pressure enables the second valve plate 41 to pivot toward the small-diameter tube 22, so that the water in the accommodation space 6 flows from the second check valve 4 to the small-diameter tube 22 and is discharged from the water outlet 51 through the passage 52.

Figure 6:
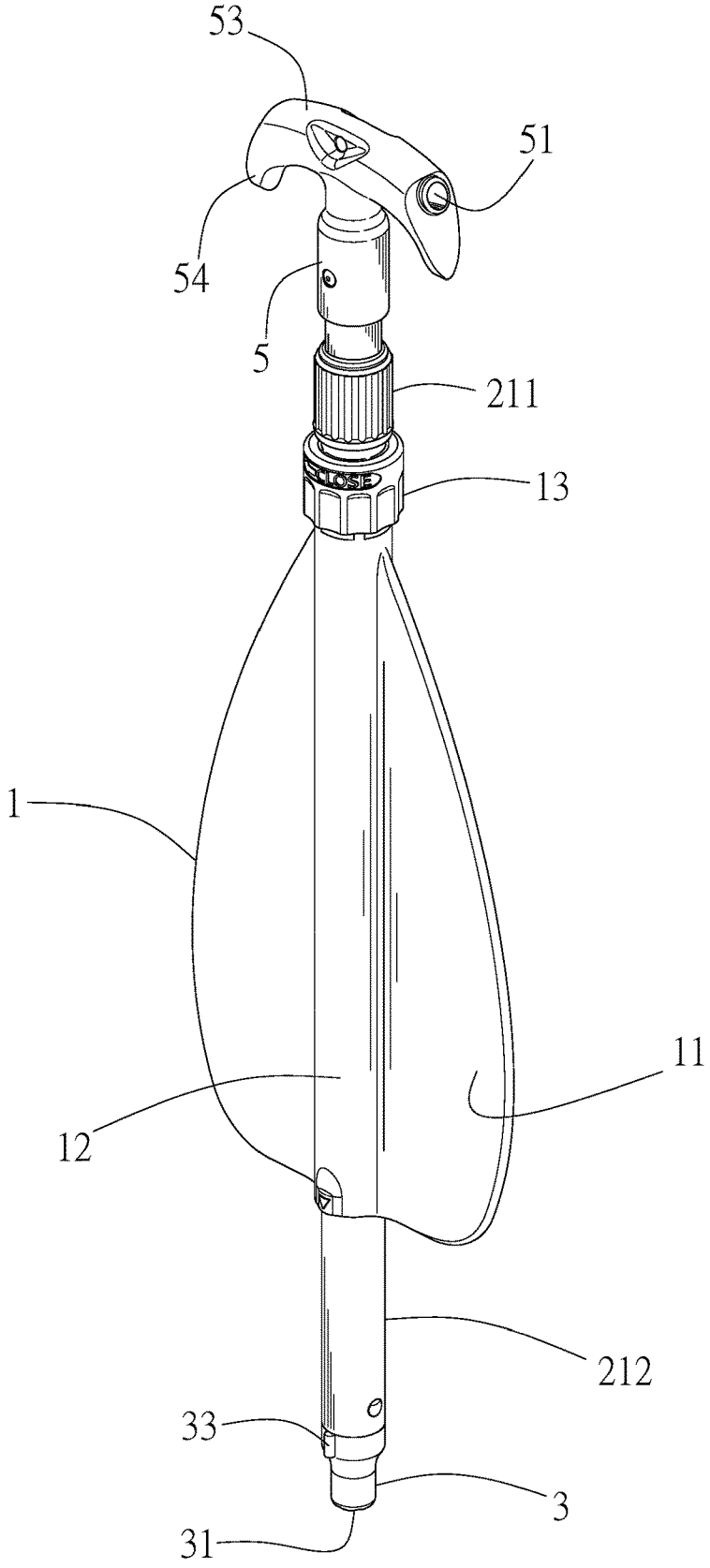
FIG. 6 is a perspective view of the present invention, wherein the bail section of the large-diameter tube is extended out of the oar blade.

Because the large-diameter tube 21 of the present invention is movable in the axial hole 123, as shown in FIG. 6, when the first control member 13 is loosened, the large-diameter tube 21 can be moved toward the oar blade 1 to extend out of the axial hole 123 to form a bail section 212. The bail section 212 is slender and cylindrical, much smaller than the width of the oar blade 1, and makes the bail opening 31 to be far away from the oar blade 1. Since the bail opening 31 has a wavy end edge 311, it is easier to bail water when the accumulated water on the boat is located in a narrow place.

As shown in FIG. 6, the bail section 212 is cylindrical, like a handle, so the user can easily hold the bail section 212 to control the operating member 5 of the oar. When used as a boat hook, the second control member 211 can be loosened to make the small-diameter tube 22 extend out of the large-diameter tube 21, thereby increasing the length of the oar to hook objects at a far position.

Figure 7:
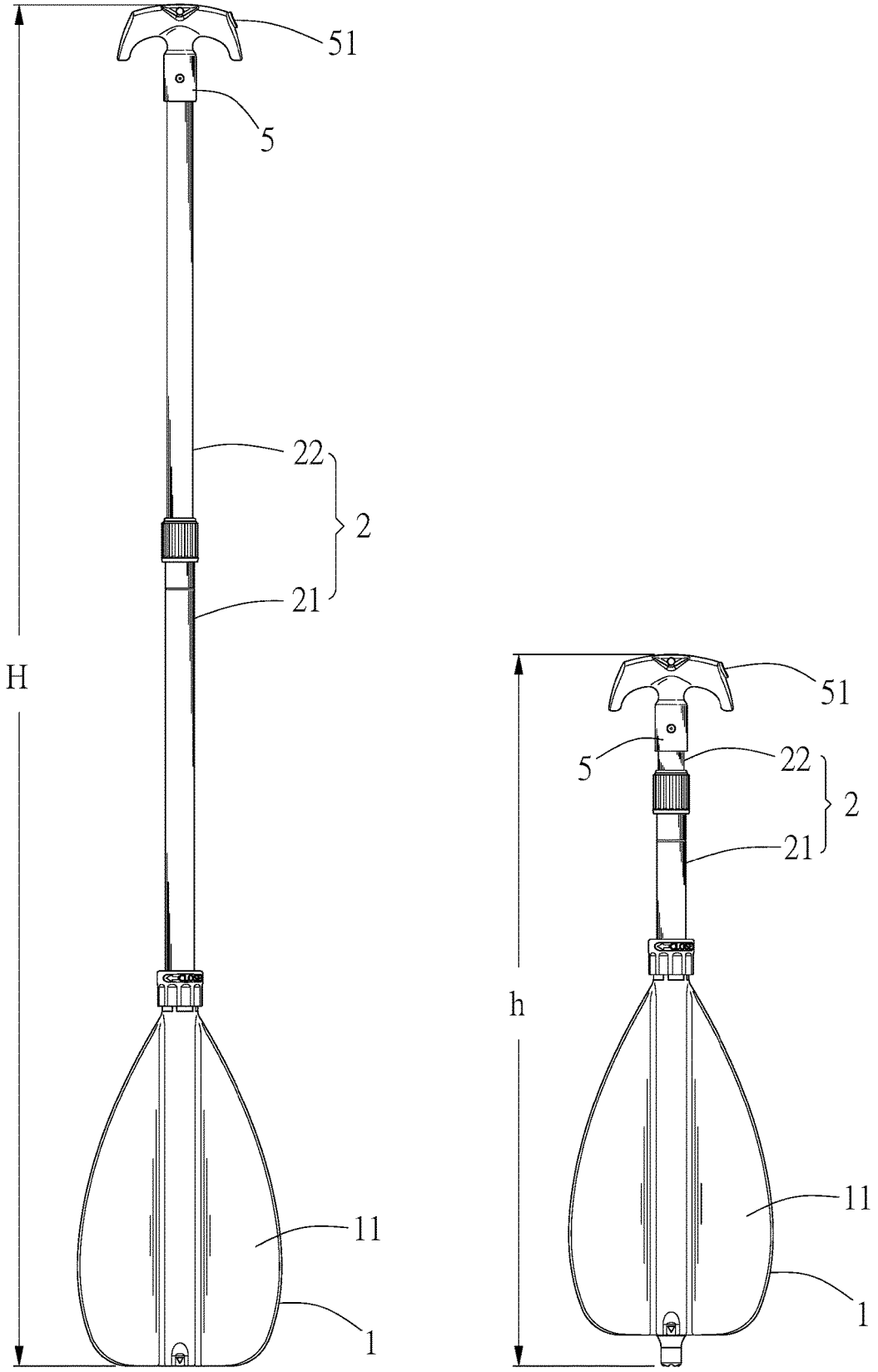
FIG. 7 is a schematic view of the longest length and the shortest length of the present invention.

In the present invention, since the oar blade 1 has the axial hole 123, a part of the large-diameter tube 21 can be extended out or retracted in the axial hole 123. The large-diameter tube 21 and the small-diameter tube 22 are movably connected. Referring to FIG. 7, when the small-diameter tube 22 is to be extended out of the large-diameter tube 21, the blocking element 33 corresponds to the slide groove 124, so that the blocking element 33 can slide along the slide groove 124 to abut against the upper positioning portion 126 (as shown in FIG. 2). In this way, the overall length of the oar is the longest length H. As shown in FIG. 7, when the small-diameter tube 22 is to be retracted in the large-diameter tube 21, the large-diameter tube 21 and the small-diameter tube 22 are received in the axial hole 123 together. Then, the blocking element 33 abuts against the lower positioning portion 127 (as shown in FIG. 3). Thus, the large-diameter tube 21 and the small-diameter tube 22 are positioned in the axial hole 123, so that the overall length of the oar is the shortest length h. Compared with conventional oars, the overall length of the oar provided by the present invention can be shortened greatly to be stored with ease. Of course, the user can adjust the length of the oar between the shortest length h and the longest length H. When in use, no matter how the relative positions of the large-diameter tube 21, the small-diameter tube 22 and the tube-connecting portion 12 are changed, after adjustment, the first control member 13 and the second control member 211 need to be locked.

What is claimed is:

1. A multi-function oar, comprising:

an oar blade, having a tube-connecting portion, the tube-connecting portion having a top end and a bottom end, a pair of plate portions being provided at two opposite sides of the tube-connecting portion, the tube-connecting portion further having an axial hole passing through the top end and the bottom end, the axial hole having means for positioning in the top end and means for positioning in the bottom end;

a large-diameter tube, inserted in the axial hole and movable axially, the large-diameter tube being provided with a first check valve facing the bottom end of the tube-connecting portion for controlling water to flow only in a direction from the bottom end toward the large-diameter tube, one end of the first check valve, opposite to the oar blade, having a bail opening, the first check valve having means for blocking the bail opening, the means for blocking cooperating with the means for positioning in the top end or the means for positioning in the bottom end;

a small-diameter tube, one end of the small-diameter tube, facing the oar blade, being provided with a second check valve for controlling water to flow only in a direction from the large-diameter tube toward the small-diameter tube, the small-diameter tube being inserted in the large-diameter tube and movable axially, an accommodation space whose volume being changeable being formed between the first check valve and the second check valve, another end of the small-diameter tube, opposite to the large-diameter tube, being provided with an operating member, the operating member having a water outlet and a passage communicating with the small-diameter tube; and wherein the top end of the tube connecting portion has means for controlling movement of the large-diameter tube relative to the oar blade, and an end of the large-diameter tube opposite the oar blade has means for controlling movement of the large-diameter tube relative to the small-diameter tube.

2. The multi-function oar as claimed in claim 1, wherein the means for blocking the bail opening is protruded outwardly from two opposite sides of an outer periphery of the first check valve, two opposite sides of an inner wall of the axial hole are recessed to form a pair of slide grooves extending along the axial hole toward the top end and corresponding to the means for blocking the bail opening for the means for blocking the bail opening to be positioned at the means for positioning in the top end, another two opposite sides of the inner wall of the axial hole are recessed to form a pair of recesses corresponding to the means for blocking the bail opening for the means for blocking the bail opening to be positioned at the means for positioning in the bottom end, so that the first check valve is blocked by the recesses to be outside the axial hole.

3. The multi-function oar as claimed in claim 1, wherein after the large-diameter tube is moved toward the oar blade to extend out of the axial hole, a bail section exposed outside the axial hole is formed.

4. The multi-function oar as claimed in claim 1, wherein a protruding portion for a user to grasp thereon extends outwardly from either side of the operating member, and the protruding portion is bent and extended toward the small-diameter tube to form a hook.

5. The multi-function oar as claimed in claim 1, wherein another end of the first check valve, facing the large-diameter tube, is provided with a spring.

6. The multi-function oar as claimed in claim 1, wherein the bail opening has a wavy end edge.

7. The multi-function oar as claimed in claim 1, wherein the first check valve includes a first valve plate that is pivotally opened only in a direction from the bail opening toward the large-diameter tube, and the second check valve includes a second valve plate that is pivotally opened only in the direction from the large-diameter tube toward the small-diameter tube.

8. The multi-function oar as claimed in claim 7, wherein the second check valve is radially provided with a pin to prevent the second valve plate from pivoting excessively.

9. The multi-function oar as claimed in claim 1, wherein each of the means for controlling movement of the large-diameter tube relative to the oar blade and the means for controlling movement of the large-diameter tube relative to the small-diameter tube is a screw tightening device.

* * * * *